US006615017B2

(12) United States Patent
Tanaka

(10) Patent No.: US 6,615,017 B2
(45) Date of Patent: Sep. 2, 2003

(54) IMAGE FORMING APPARATUS CAPABLE OF PREVENTING RECORDING MATERIAL FROM BEING TWINED

(75) Inventor: Noriaki Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/953,951

(22) Filed: Sep. 18, 2001

(65) Prior Publication Data

US 2002/0037186 A1 Mar. 28, 2002

(30) Foreign Application Priority Data

Sep. 25, 2000 (JP) ..... 2000-291027

(51) Int. Cl.[7] ..... G03G 15/20
(52) U.S. Cl. ..... 399/322; 399/323
(58) Field of Search ..... 399/9, 16, 18, 399/21, 122, 322, 323; 219/216, 469; 271/174, 307, 311, 289, 290, 312, 313, 900

(56) References Cited

U.S. PATENT DOCUMENTS 4,065,120 A * 12/1977 Imaizumi et al. ..... 217/174
5,315,359 A * 5/1994 Nishikawa ..... 399/323
5,525,775 A 6/1996 Setoriyama et al. ..... 219/216
6,029,038 A * 2/2000 Uehara et al. ..... 399/323
6,205,316 B1 * 3/2001 Iida ..... 399/323

FOREIGN PATENT DOCUMENTS

| | | |
|---|---|---|
| JP | 4-44033 | 2/1992 |
| JP | 4-44075 | 2/1992 |
| JP | 9-236958 | 9/1997 |
| JP | 10-74015 | 3/1998 |

* cited by examiner

*Primary Examiner*—Hoan Tran
(74) *Attorney, Agent, or Firm*—Fitzpatrick, Cella, Harper & Scinto

(57) ABSTRACT

An image heating apparatus includes a heater having a nip that nips and transports a recording material that bears an image, the heater having a rotary member that comes into contact with the recording material; and a moving member disposed downstream of the nip in a moving direction of the recording material so as to be movable between a first position the moving member abuts against the rotary member and a second position in that the moving member is apart from the rotary member, wherein the moving member is positioned in the second position when the recording material is normally transported, and the moving member moves to the first position when the recording material is abnormally transported downstream of the nip.

20 Claims, 17 Drawing Sheets

IMAGE FORMING APPARATUS CAPABLE OF PREVENTING RECORDING MATERIAL FROM BEING TWINED

BACKGROUND OF THE INVENTION

1. Field of the Invention

The present invention relates to an image heating apparatus that is represented by a heat fixing device mounted on an image forming apparatus such as a copying machine or a printer, a device that heats an image on a recording sheet to improve the surface property of the image, and the like.

2. Description of the Related Art

For example, in an electrophotographic image forming apparatus of a transfer system which is equipped with the above-mentioned image heating apparatus as a toner image heat fixing device for the recording sheet onto which a toner image has been transferred, if a trouble such as jamming occurs downstream of a nipping portion to thereby shut out the transportation of the recording sheet, the recording sheet is not transported anywhere, and the recording sheet is caught by a heating unit, resulting in a state where a jam clearance is difficult.

For that reason, in order to solve the above problem, up to now, various techniques have been disclosed, for example, in Japanese Patent Application Laid-open No. 10-74015, Japanese Patent Application Laid-open No. 9-236958, and the like.

Japanese Patent Application Laid-open No. 10-74015 discloses a fixing device for use in an image forming apparatus that is characterized in that a separation claw is always urged by a spring toward a direction along which the separation claw is in press contact with a fixing roller that functions as a heating unit, and when the separation claw is moved in a fixing roller outer peripheral direction by a jammed sheet, the movement of the separation claw is detected by a sensor to detect that the recording sheet is caught by the fixing roller.

Also, Japanese Patent Application Laid-open No. 9-236958 discloses an image forming apparatus that is characterized in that twine of the recording sheet around the heating roller is detected by a torque value that is detected by a torque detecting means that detects a load torque of the heating roller which is disposed between a drive device and the heating roller that functions as a heating unit.

FIG. 14 is a schematic structural view showing an example of an image heating apparatus, which employs a film heating method and a pressure roller drive method and is a tensionless type using a cylindrical thin heat-resistant film. This image heating apparatus is disclosed in, for example, Japanese Patent Application Laid-open Nos. 4-44075 and 4-44033 and the like.

A heating unit 1 is a laterally elongated member that is longitudinal in a direction vertical to a drawing plane of FIG. 1. The heating unit 1 is made up of a stay 6 that is of the semi-arc trough shape in a lateral cross-section and has a heat resistance and rigidity; a plane shaped heating member (for example, a ceramic heater) H that is laterally elongated, thin and has a low heat capacity which is fixingly fitted into a seat groove portion provided in a lower surface of the stay 6 along the longitudinal direction of the stay; a thin heat-resistant film 5 that is loosely externally fitted onto the stay 6 to which the heating member H is attached; a rigid pressure member 11 a lateral section of which is of a U-shape that is directed downward which is inserted into the stay 6, and the like.

The pressure roller unit 2 is made up of a core 2*a* and a heat-resistant elastic material layer 2*b* that is coaxially molded on the outer periphery of the core 2*a* into a roller shape. The pressure roller unit 2 is disposed so that both end portions of the core 2*a* are rotatably held between side plates (not shown) at front and back sides of a device chassis 12 through bearings (not shown).

The heating unit 1 is disposed on the upper side of the pressure roller unit 2 in parallel with the pressure roller unit 2 in such a manner that the heating member R side is directed downward, and both end portions of the rigid pressure member 11 are urged against the pressure roller unit 2 by a pressure urging member (not shown), to thereby bring the downwardly directed surface of the heating member H in pressure contact with the heat-resistant elastic material layer 2*b* of the pressure roller unit 2 through the thin heat-resistant film 5 against the elasticity of the elastic material layer under a given pressure force to form a nip portion N with a given width as a heating portion.

The pressure roller unit 2 is rotationally driven at a given peripheral speed in a counterclockwise direction "a" indicated by an arrow by a drive means M. A rotating force is exerted on a cylindrical thin heat-resistant film 5 due to a pressure contact frictional force at the nip portion N between the outer surface of the pressure roller unit 2 and the thin heat-resistant film 5 caused by the rotation of the pressure roller unit 2. The thin heat-resistant film 5 is rotated in a clockwise direction a' indicated by an arrow on the outer periphery of the stay 6 while the inner surface of the thin heat-resistant film 5 is slid in close contact with the downwardly directed surface of the heating member H.

The pressure roller unit 2 is rotationally driven with the state where the cylindrical thin heat-resistant film 5 is rotated by the rotation of the pressure roller unit 2. Also, the heating member H is energized, and the temperature of the heating member H rises and is adjusted up to a given temperature. In such states, a recording sheet S that bears an unfixed toner image T is introduced between the thin heat-resistant film 5 and the pressure roller unit 2 in the nip portion N, and the recording sheet S is nipped and transported together with the thin heat-resistant film 5 in a state where the toner image bearing surface side of the recording sheet S is in close contact with the outer surface of the thin heat-resistant film 5 at the fixing nip portion N. In the nipping and transporting process, the heat of the heating member H is imparted to the recording sheet through the thin heat-resistant film 5, and the unfixed toner image T on the recording sheet S is heated and pressurized on the recording sheet S to make fusion fixation T'.

The stay 6 of the heating unit 1 is equipped with a semi-circular separation curved portion 9 that is formed continuously in the widthwise direction of the recording sheet S downstream of the nip portion N in the thin heat-resistant film rotation direction, and the curvature of the thin heat-resistant film 5 is partially made large, to thereby self-strip the recording sheet S that has passed the nip portion N from the thin heat-resistant film 5.

The recording sheet S that has been self-stripped from the thin heat-resistant film 5 passes through upper and lower guide plates 13 and relayed by a pair of delivery rollers 4 so as to be transported and delivered.

Also, because the heating unit 1 and the pressure roller unit 2 become high in temperature, in order to prevent a user from directly touching those units 1 and 2, there is provided a fixing cover 3 that covers the heating unit 1 and the pressure roller unit 2.

In the above-mentioned image heating apparatus, as shown in FIG. 15, when jamming occurs due to some cause, and the recording sheet S becomes in an accordion state inside of the fixing cover 3, there is no space into which the trailing end of the recording sheet S is inserted, resulting in a fear such that the thin heat-resistant film 5 rotates in such a state where the recording sheet S and the thin heat-resistant film 5 are in close contact with each other through the toner and the recording sheet is inserted into the nip portion N again. As a result, the trailing end of the recording sheet S and a portion of the recording sheet which has been inserted into the nip portion N again are allowed to adhere to each other with toner T, and the jam clearance becomes difficult.

In order to overcome the above drawback, as shown in FIG. 17, a rib R is disposed on a wall of the fixing cover 3 downstream of the heating unit 1, and a clearance "t" N between the rib R and the heating unit 1 is narrowed to prevent the twine of the recording sheet S around the thin heat-resistant film 5.

The above-mentioned respective conventional arts have the effect of preventing the recording sheet S from being twined around the heating unit 1, but are desired to improve the following matters.

That is, the device disclosed in Japanese Patent Application Laid-open No. 10-74015 requires a shaft and a lever member for the spring for press-contacting the separation claw to the fixing roller that functions as the heating unit and the twine detection as described above, and therefore becomes complicated in its structure. Also, because a force is always applied to the fixing roller in a direction along which the separation claw is in press contact with the fixing roller, a slight amount of toner that is stuck onto the fixing roller is stuck onto the extremity of the separation claw and laminated. If the laminated toner is stuck onto the fixing roller again, an image stain occurs on the recording sheet, or an expensive material to which the toner is not stuck is required to be used. Also, because the separation claw is always urged against the fixing roller, a specific and expensive material that is high in heat resistance and prevents the fixing roller from being damaged must be selected. In addition, because the separation claw is so structured as to always urge the separation claw against the fixing roller, there arises such a problem that the fixing roller is liable to be damaged in assembling.

Also, the device disclosed in Japanese Patent Application Laid-open No. 9-236958 detects the twine of the recording sheet on the basis of a torque value detected by the torque detecting means that detects the load torque of the heating roller which is disposed between the driving device and the heating roller that functions as the heating unit as described above. If the heating roller is made small in diameter for the efficiency of the heat transfer and also made high in speed, even if the operation of the drive device stops after the detection of the torque, the recording sheet is conveyed by the inertia of the heating roller or the like, and the jam clearance of the recording sheet twined around the heating roller becomes difficult.

Further, in the image heating apparatus of the film heating system shown in FIG. 17, even if the clearance t is set to be narrow as described above, when the printing density on the recording sheet S is high, there is a fear that the thin heat-resistant film 5 and the recording sheet S are brought in close contact with each other through the toner, the thin heat-resistant film is pushed against the recording sheet S, the clearance t between the recording sheet S and the fixing cover 3 is widened, the recording sheet S passes through the clearance "t", and the recording sheet S is wound on the thin heat-resistant film 5.

SUMMARY OF THE INVENTION

The present invention has been made in view of the above-mentioned problems, and therefore an object of the present invention is to provide an image heating apparatus that is capable of preventing a recording material from being twined around a rotary member.

Another object of the present invention is to provide an image heating apparatus that is capable of preventing the recording material from being twined around the rotary member while a damage on the rotary member is reduced.

Still another object of the present invention is to provide an image heating apparatus that readily conducts a jam clearance after the recording material has been jammed.

In order to achieve the above objects, according to the present invention, there is provided an image heating apparatus, comprising:

heating means having a nip that nips and transports a recording material that bears an image, the heating means having a rotary member that is in contact with the recording material; and a moving member disposed downstream of the nip in a moving direction of the recording material so as to be movable between a first position in which the moving member abuts against the rotary member and a second position in which the moving member is apart from the rotary member, wherein the moving member is positioned in the second position when the recording material is normally transported, and the moving member moves to the first position when the recording material is abnormally transported downstream of the nip.

Other objects of the present invention will become apparent by reading the following detailed description with reference to the accompanying drawings.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of an image heating apparatus to which the present invention is applied and an image forming apparatus having the image heating apparatus as a fixing device with reference to the accompanying drawings.

(First Embodiment)

(A) Example of an Image Forming Apparatus

Figure 1:
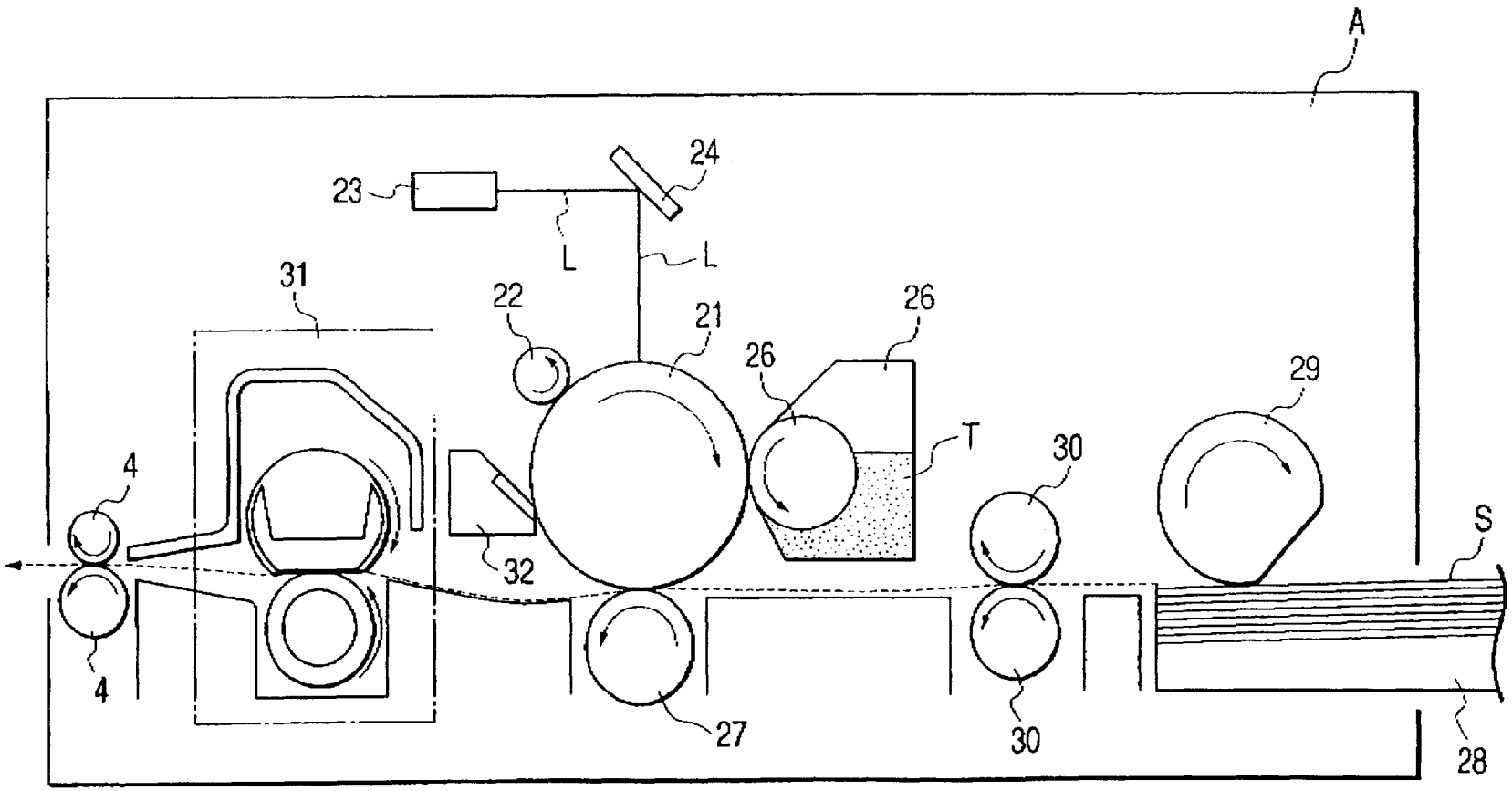
FIG. 1 is a schematic structural view showing an example of an image forming apparatus in accordance with a first embodiment of the present invention.

FIG. 1 is a schematic structural view sowing an example of an image forming apparatus having an image heating apparatus of the present invention as a fixing device of a toner image. An image forming apparatus A of this example is directed to a laser printer using a transfer electrophotographic process.

A drum-shaped electrophotographic photosensitive member (hereinafter referred to as "photosensitive drum") 21 is rotationally driven at a predetermined peripheral speed in a clockwise direction indicated by an arrow.

The photosensitive drum 21 is subjected to the uniform charge of a predetermined polarity and potential by a charging roller 22 during its rotating process, and then subjected to a laser scanning exposure light L of image information by a laser scanner 23, to thereby form an electrostatic latent image corresponding to the image information on its peripheral surface. Reference numeral 24 denotes a laser beam deflecting mirror.

The electrostatic latent image formed on the photosensitive drum 21 is subjected to reversal development or normal development as a toner image by a developing device 25. A developing roller 26 is disposed in the developing device 25.

A transfer roller 27 is brought into pressure contact with the photosensitive drum 21 to form a transfer nip portion.

Recording sheets (recording materials) S are stacked and contained in a feed cassette 28. One recording sheet S is separated and fed from the interior of the feed cassette 28 by driving a feed roller 29, and then fed to the transfer nip portion by a registration roller 30 at a predetermined control timing, and toner images on the photosensitive drum 21 surface side are sequentially transferred to the surface of the recording sheet S.

The recording sheet S that has passed through the transfer nip portion is separated from the surface of the photosensitive drum 21 and then introduced into the fixing device 31 where the recording sheet S is subjected to a heat fixing process of the toner image, and thereafter the recording sheet S is delivered to the exterior of the apparatus by the pair of delivery rollers 4.

Also, a residual attachment such as non-transferred toner is removed from the surface of the photosensitive drum 21 after the recording sheet S has been separated from the photosensitive drum 21 surface by a cleaning device 32 so that the surface of the photosensitive drum 21 is cleaned, and the photosensitive drum 21 is repeatedly employed to form an image.

(B) Fixing Device 31

Figure 2:
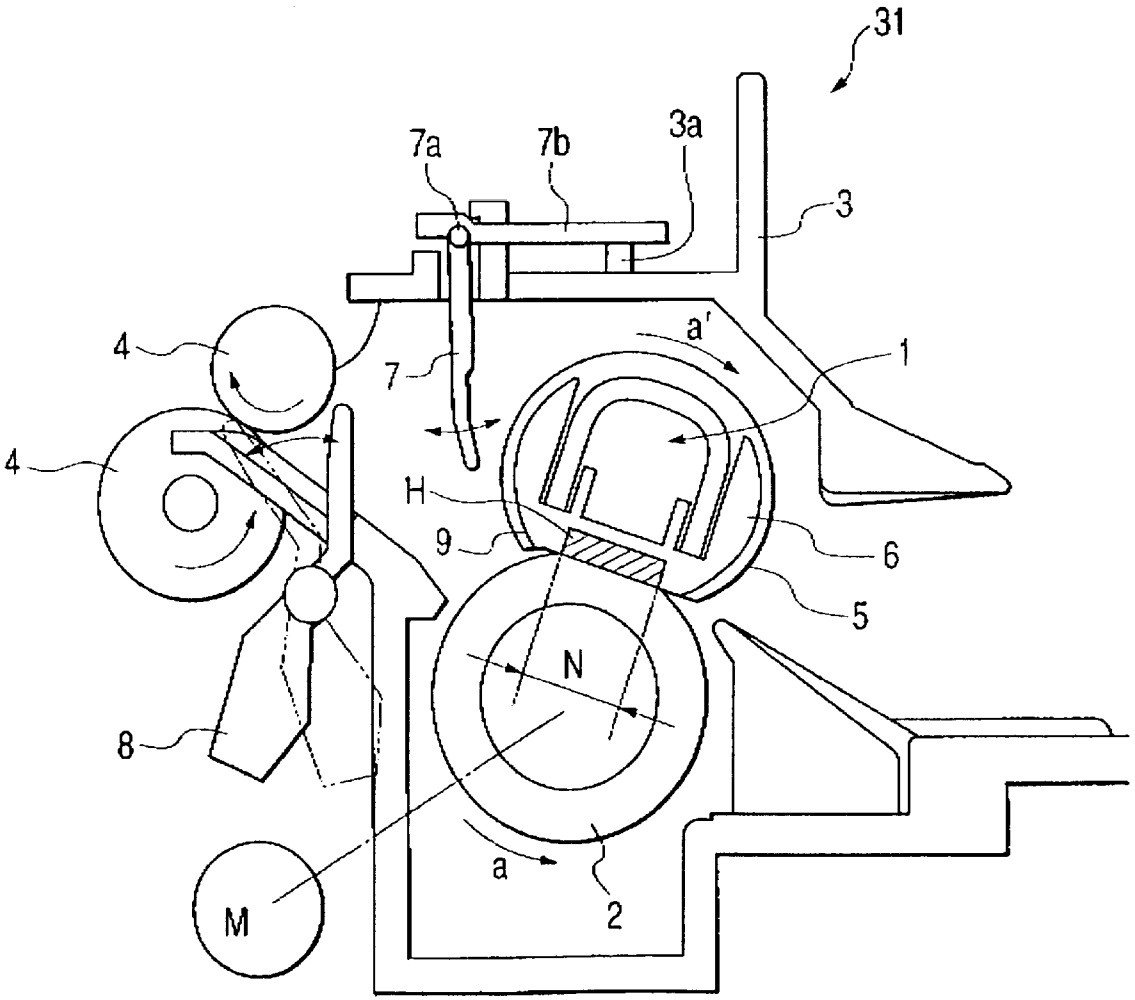
FIG. 2 is a schematic cross-sectional view showing a fixing device.
Figure 14:
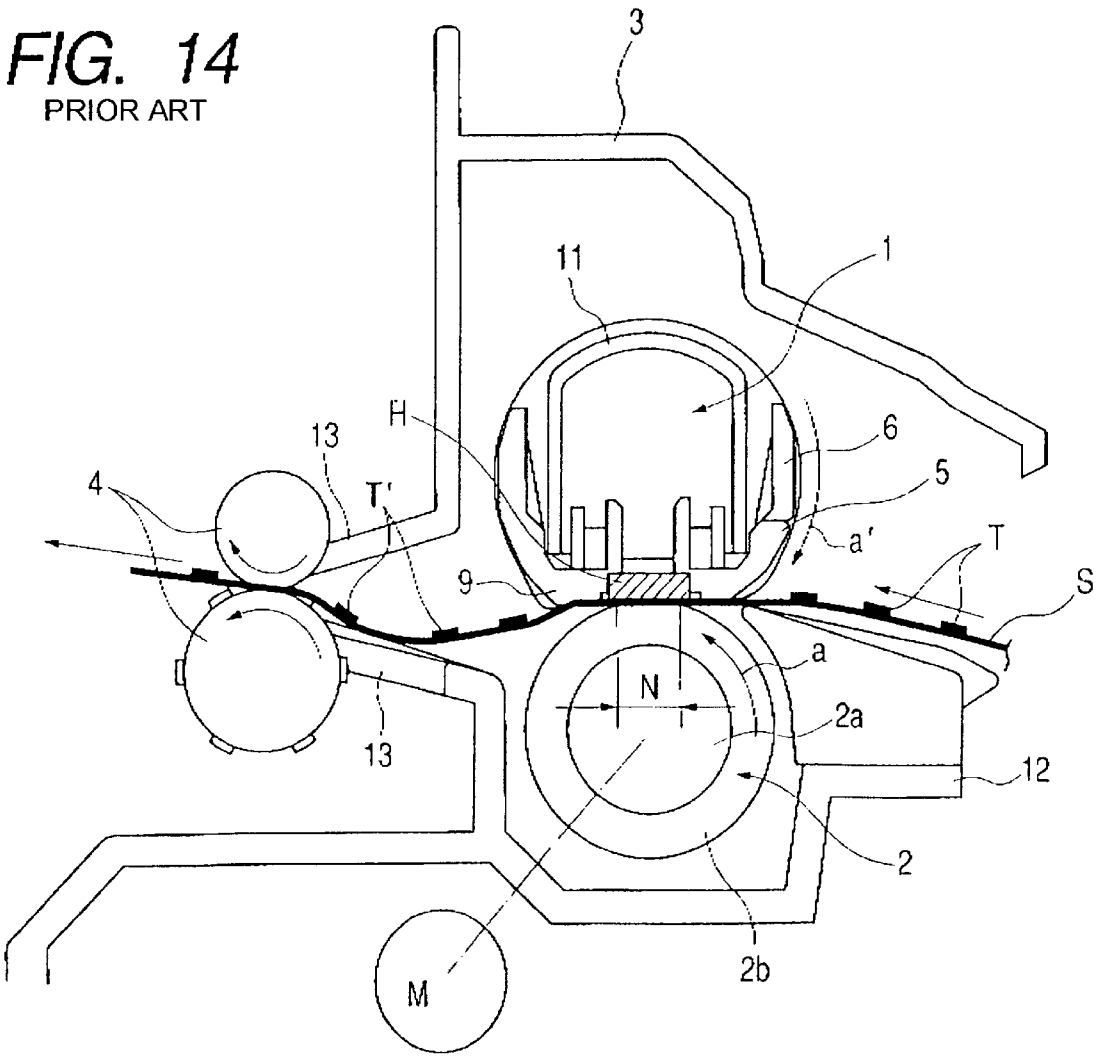
FIG. 14 PRIOR ART
FIG. 14 is a schematic cross-sectional view showing a conventional fixing device.
Figure 15:
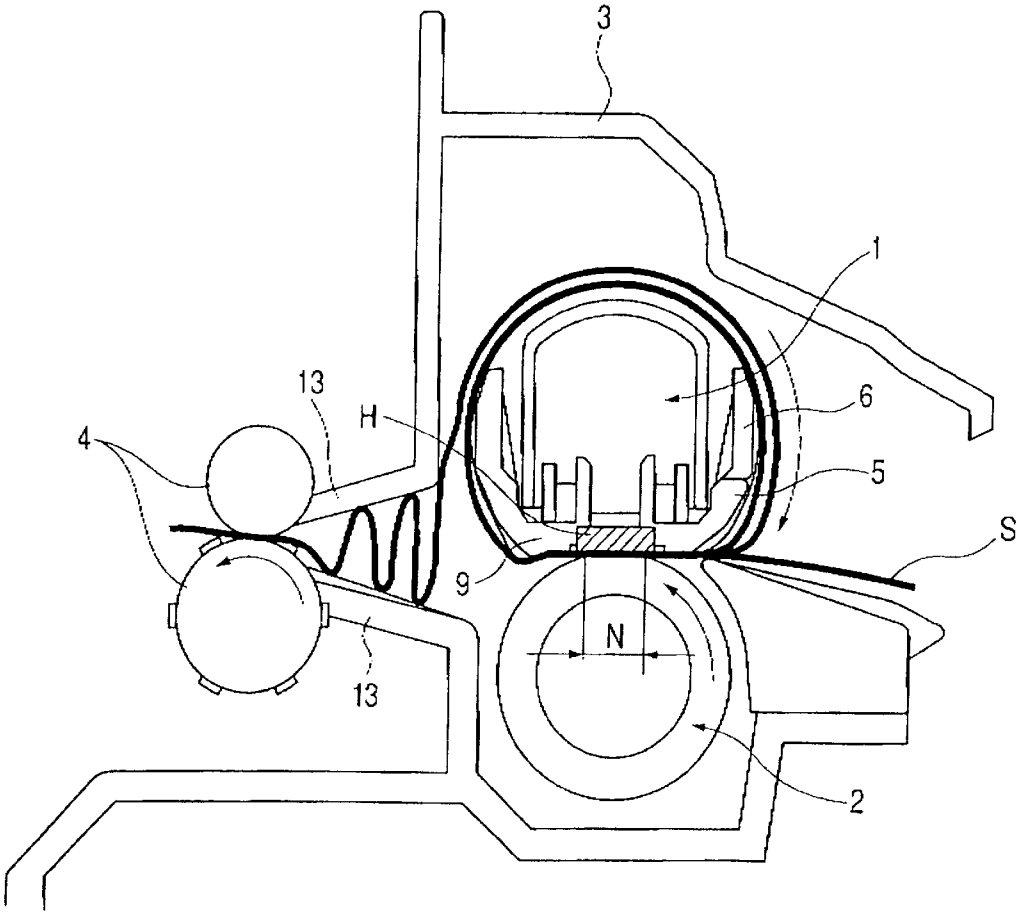
FIG. 15 PRIOR ART
FIG. 15 is a schematic cross-sectional view showing a state in which a recording sheet is twined around a heating unit.
Figure 16:
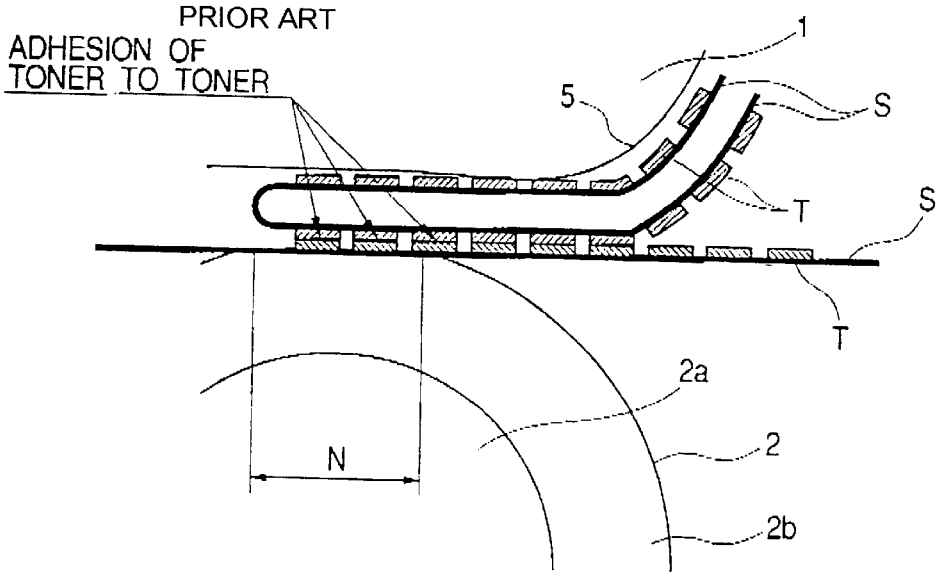
FIG. 16 PRIOR ART
FIG. 16 is a diagram for explaining that toners on the twined recording sheet adhere to each other.
Figure 17:
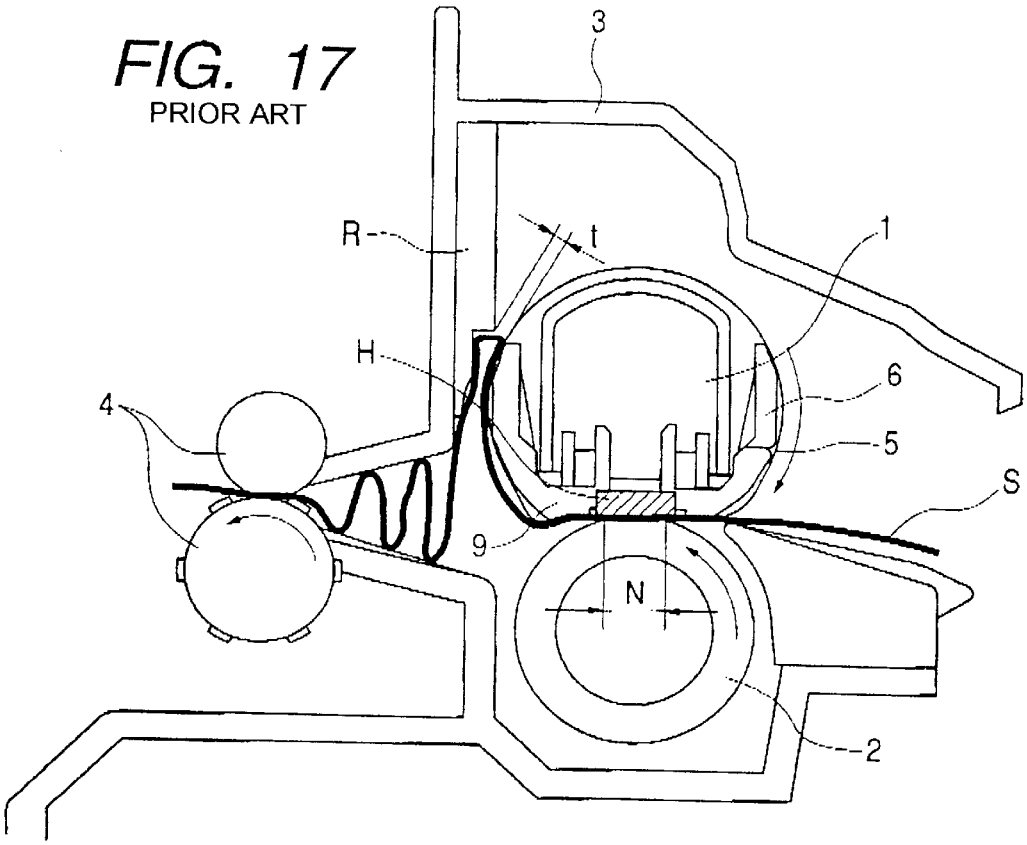
FIG. 17 PRIOR ART
FIG. 17 is a schematic cross-sectional view showing a conventional countermeasure against a twine of the recording sheet on a heating unit.
Figure 18:
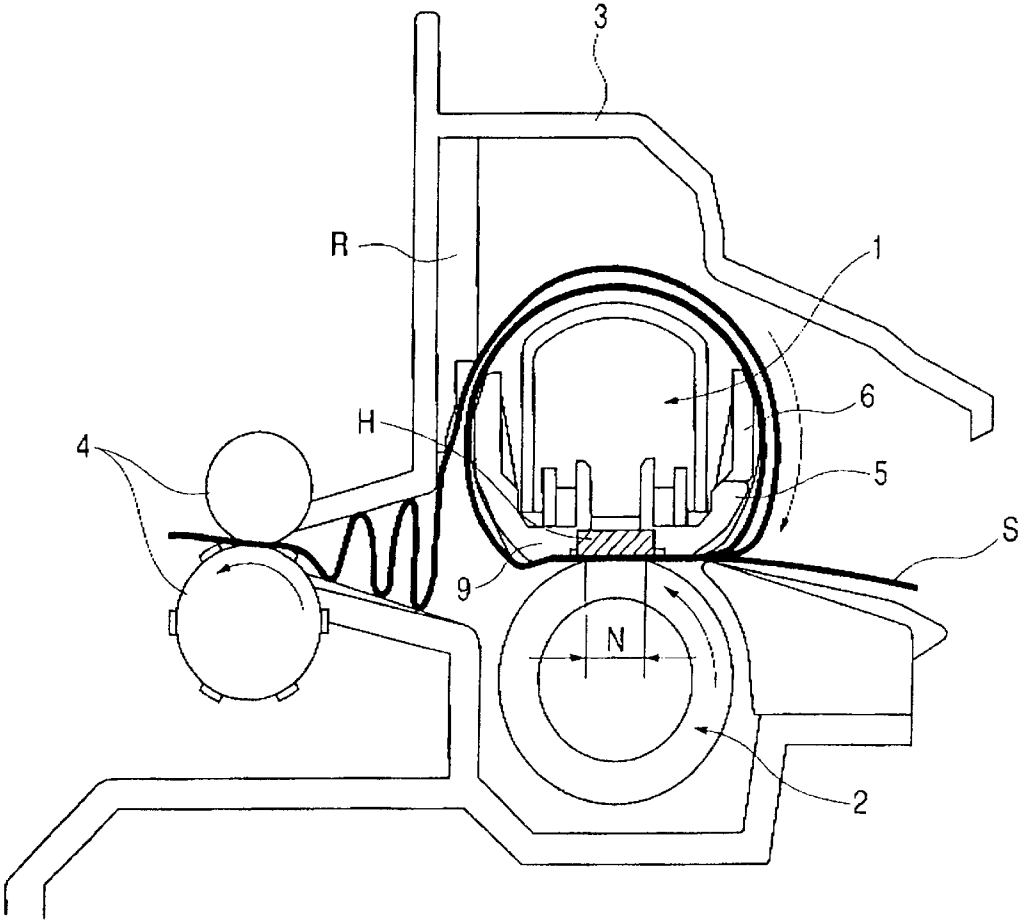
FIG. 18 PRIOR ART
FIG. 18 is a schematic cross-sectional view showing a state in which the twine of the recording sheet around the heating unit occurs in the conventional countermeasure.

FIG. 2 is a schematic structural view showing the fixing device 31 as an image heating apparatus. The fixing device 31 is an image heating apparatus of the film heating system, the pressure roller drive system, and the tensionless type using a cylindrical thin heat-resistant film as in the above-mentioned fixing device shown in FIG. 14. The same structural members and parts as those of the fixing device shown in FIG. 14 are denoted by identical reference numerals, and their repeated description will be omitted.

Figure 3:
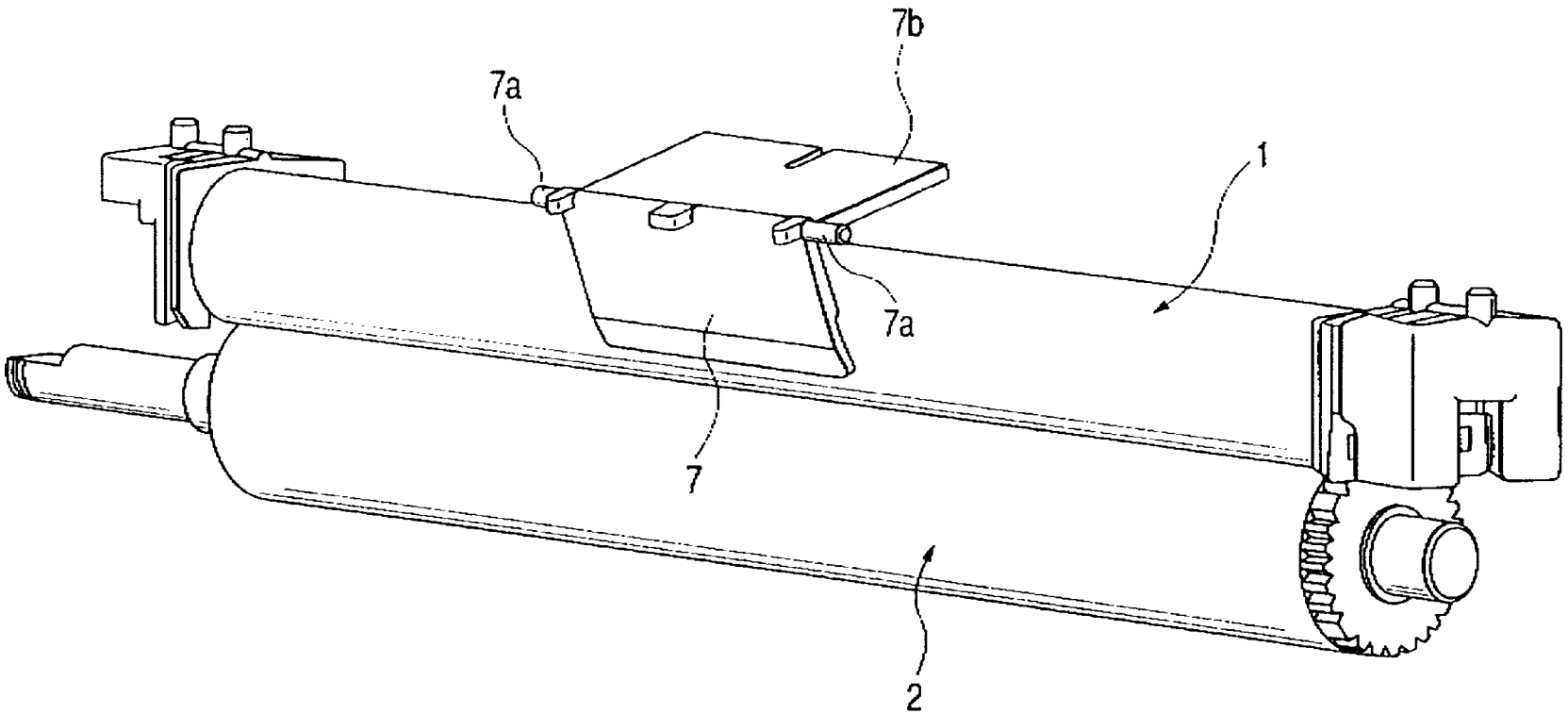
FIG. 3 is a schematic view (Type 1) in which a separation claw is arranged.
Figure 4:
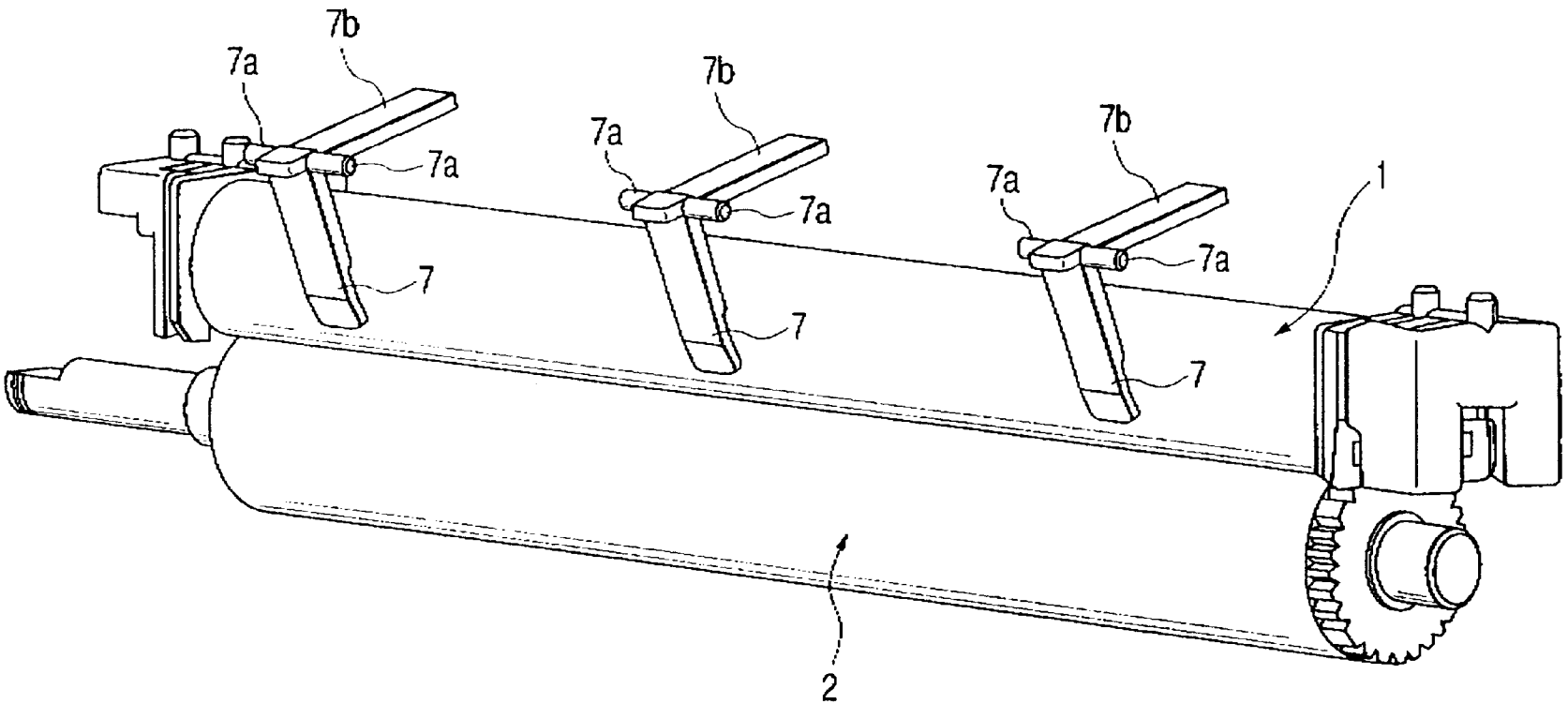
FIG. 4 is a schematic view (Type 2) in which a separation claw Is arranged.

Reference numeral 7 denotes a separation claw (moving member), and for example, one separation claw may be positioned in substantially the center of the heating unit 1 in a longitudinal direction as shown in FIG. 3, or two or more separation claws may be positioned on the heating unit 1 at intervals in the longitudinal direction. A fixing cover 3 is omitted in FIGS. 3 and 4.

The separation claw 7 is designed such that a lateral shaft portion 7*a* disposed on an upper end side of the separation claw 7 is held on a bearing portion (not shown) disposed on the fixing cover 3 side by means of bearings, and the separation claw 7 is hung from the fixing cover 3 downstream of the nip portion of the heating unit 1 (downstream of the nip portion in the recording sheet transporting direction) and swingable with the lateral shaft portion 7*a* as a center. Also, the upper end portion of the separation claw 7 is equipped with an arm portion 7*b* which is bent substantially vertically on the right side of the drawing, and a rotary moment in the clockwise direction of the drawing with the lateral shaft portion 7*a* as a center is exerted on the separation claw 7 by the weight of the arm portion 7*b*. Then, in a stationary state (free state), the arm portion 7*b* falls down by its weight with the lateral shaft portion 7*a* as a center in the clockwise direction, rotates and is received by a receiving portion 3*a* disposed on the upper surface of the fixing cover 3. In this situation, the distal end of the separation claw 7 is apart from the surface of the thin heat-resistant film 5 of the heating unit 1. In this state, a clearance between the surface of the thin heat-resistant film 5 and the distal end of the separation claw 7 is set to 0.2 mm to 5 mm, preferably 0.5 mm to 2.5 mm.

In addition, the distal end of the separation claw 7 at the thin heat-resistant film 5 side is smoothly shaped with R 0.5 mm.

In the stationary state, the recording sheet S that has been subjected to the transfer of the toner image at the transfer portion and then introduced into the fixing device 31 is nipped and transported by the nip portion N of the fixing device 31, to thereby fix the toner image on the recording sheet with the heat from the heater H and the nip pressure through the thin heat-resistant film 5. The recording sheet S that has passed through the nip portion N and is brought into close contact with the thin heat-resistant film 5 with the toner is separated from the thin heat-resistant film 5 by the separation curved portion 9 of the stay 6, and then transported to the pair of delivery rollers 4. In this state, the separation claw 7 is maintained in a state where the separation claw 7 is apart from the surface of the thin heat-resistant film 5 of the heating unit 1.

A delivery sensor flag 8 falls down by a contact with the recording sheet S that goes out of the fixing nip portion N, is separated from the fixing film 5 and then transported to the pair of delivery rollers 4, to thereby detect the recording sheet that passes through the pair of delivery rollers 4 in cooperation with a sensor portion (not shown).

In other words, the delivery sensor flag 8 is in a standing state as indicated by a solid line of FIG. 2 when no recording sheet S exists, while the sensor portion is in a switched-off state. When the recording sheet is transported from the fixing nip portion N to the pair of delivery rollers 4, the delivery sensor flag 8 falls down by the leading end of the recording sheet as indicated by a chain double-dashed line, and is held in the fall-down state until the trailing end of the recording sheet passes through the pair of delivery rollers 4, during which the sensor portion is held in a switched-on state. A control portion (not shown) detects the absence of the recording sheet In response to an off-signal from the sensor portion, and detects the presence of the recording sheet in response to the on-signal.

The control portion recognizes that the recording sheet is normally delivered and transported when the duration of the on-signal from the sensor portion is within a predetermined range. In the case where the duration of the on-signal exceeds the predetermined range, the control portion recognizes that jamming of the recording sheet occurs between the fixing nip portion N and the pair of delivery rollers 4, and emergently stops the printer drive means including the pressure roller unit drive means M and indicates the occurrence of jamming on a display portion, and prompts an operator to the jam clearance.

In the above-mentioned structure, when the recording sheet S is not transported forwardly from the pair of delivery rollers 4 due to some cause, the recording sheet S becomes in an accordion state within the fixing cover 3 and between the pair of delivery rollers 4 and the nip portion N, and the jammed recording sheet portion is brought into contact with the outer surface side of the separation claw 7 (a surface of the separation claw 7 opposite to the heating unit 1 side) and pressed, with the result that the separation claw 7 starts to rotate toward the heating unit 1 side in the counterclockwise direction against the rotating moment of the clockwise direction which is caused by the self weight of the arm portion 7*b*, and the smooth distal end of the separation claw 7 with a radius R of 0.5 mm and the surface of the thin heat-resistant film 5 of the heating unit 1 are finally abutted against each other.

In addition, when the recording sheet S is transported, there is no space to which the recording sheet S goes, as a result of which the recording sheet S and the thin heat-resistant film 5 are not separated from each other at the separation curved portion 9, and the recording sheet S starts to be brought in close contact with and twined around the thin heat-resistant film 5 through the toner.

The recording sheet S that has started to be twined around the thin heat-resistant film 5 is partially separated from the thin heat-resistant film 5 by the separation claw 7 that is abutted against the surface of the thin heat-resistant film 5 of the heating unit 1, to thereby prevent the twine of the recording sheet S.

Figure 5:
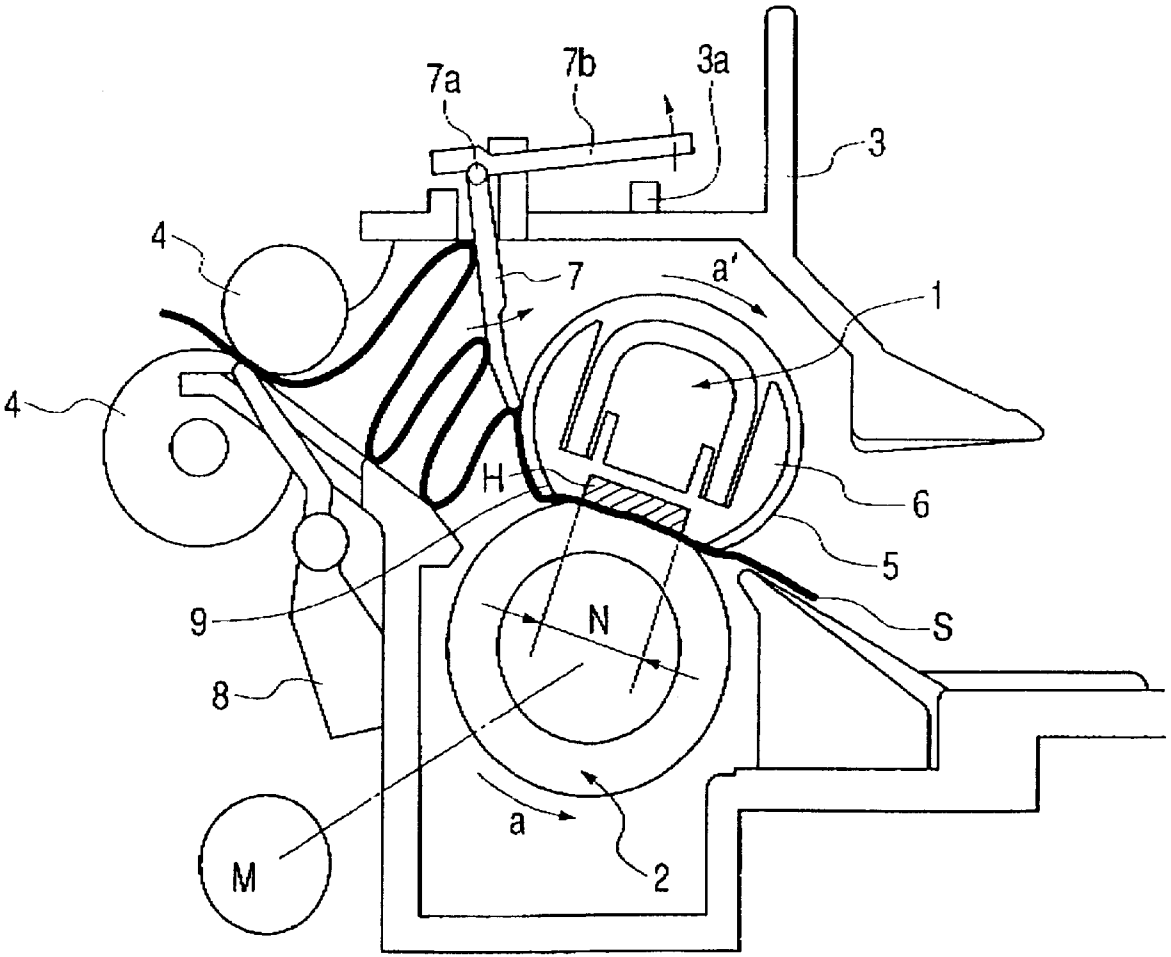
FIG. 5 is a schematic cross-sectional view showing a jamming state.

FIG. 5 is a diagram showing the above-mentioned jamming state of the recording sheet S. The separation claw 7 rotates in a counterclockwise direction with the lateral shaft portion 7*a* as a center and its distal end portion is abutted against the surface of the thin heat-resistant film 5 of the heating unit 1 by pressing the jammed recording sheet portion in contact with the outer surface of the separation claw, and the arm portion 7*b* lifts up and floats from the receiving portion 3*a* on the upper surface of the fixing cover 3.

When the recording sheet S that cannot go anywhere is further transported, the recording sheet S becomes in a small accordion state at the lower portion of the separation claw 7, or slips at the nip portion N.

The emergent stop of the printer drive means including the pressure roller unit drive means M in accordance with the detection of jamming by the control portion is made at the time in that the duration of the on-signal from the sensor portion on the basis of the fall-down of the delivery sensor flag 8 exceeds the given range as described above.

Figure 6:
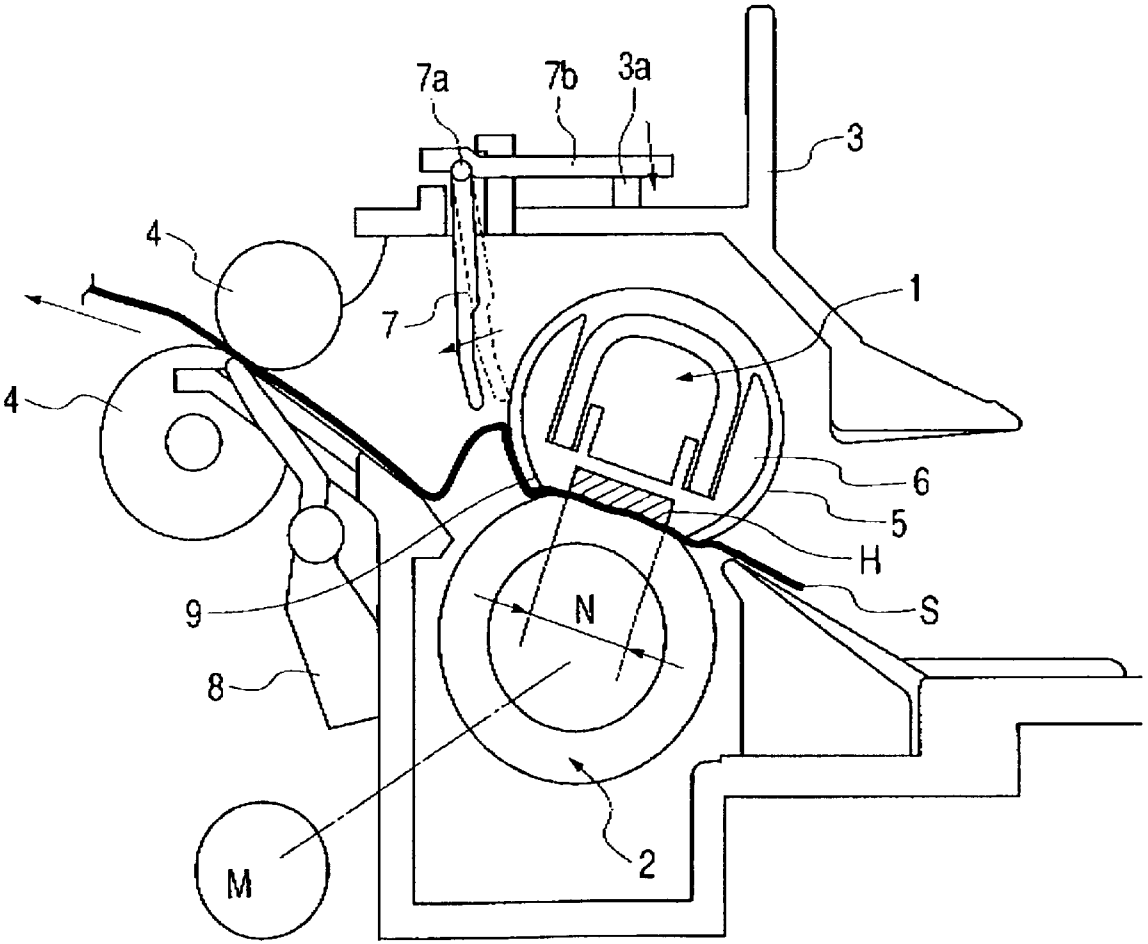
FIG. 6 is a schematic cross-sectional view showing a jam clearance.

Subsequently, the jam clearance will be described. When the recording sheet S that is in the accordion state is drawn out of the downstream side of the pair of delivery rollers 4, the accordion portion at the downstream side within the fixing cover 3 disappears as shown in FIG. 6, and the separation claw 7 is returned to the stationary state position by the self weight of the arm portion 7*b*.

Thereafter, the recording sheet S is drawn out of the pair of delivery rollers 4 side without difficulty, and the jam clearance is attained without tearing the jammed sheet.

As described above, the reset process of the printer is conducted after the jammed recording sheet has been removed, thereby being capable of re-starting the printing operation.

As described above, according to this embodiment, the separation claw 7 is arranged without contacting with the thin heat-resistant film 5 of the heating unit 1 during the normal fixing time, and the separation claw 7 does not come in contact with the thin heat-resistant film 5 until the jamming occurs. For that reason, no excessive force is applied to the thin heat-resistant film 5, a damage and an excessive abrasion on the thin heat-resistant film 5, and the toner stain on the separation claw 7 are reduced as much as possible, and the twine of the recording sheet S around the heating unit 1 is prevented with a relatively inexpensive mechanism, to thereby make it possible that the user conducts the jam clearance according to a simple procedure. Also, because a method of arranging the separation claw 7 is simple, and the separation claw 7 is arranged from the upper side of the fixing cover 3, the separation claw 7 can be assembled without damaging the heating unit 1.

In addition, because the distal end of the separation claw 7 is smoothly shaped with a radius R of 0.5 mm, it is possible to further prevent the thin heat-resistant film 5 from being damaged.

(Second Embodiment)

Figure 7:
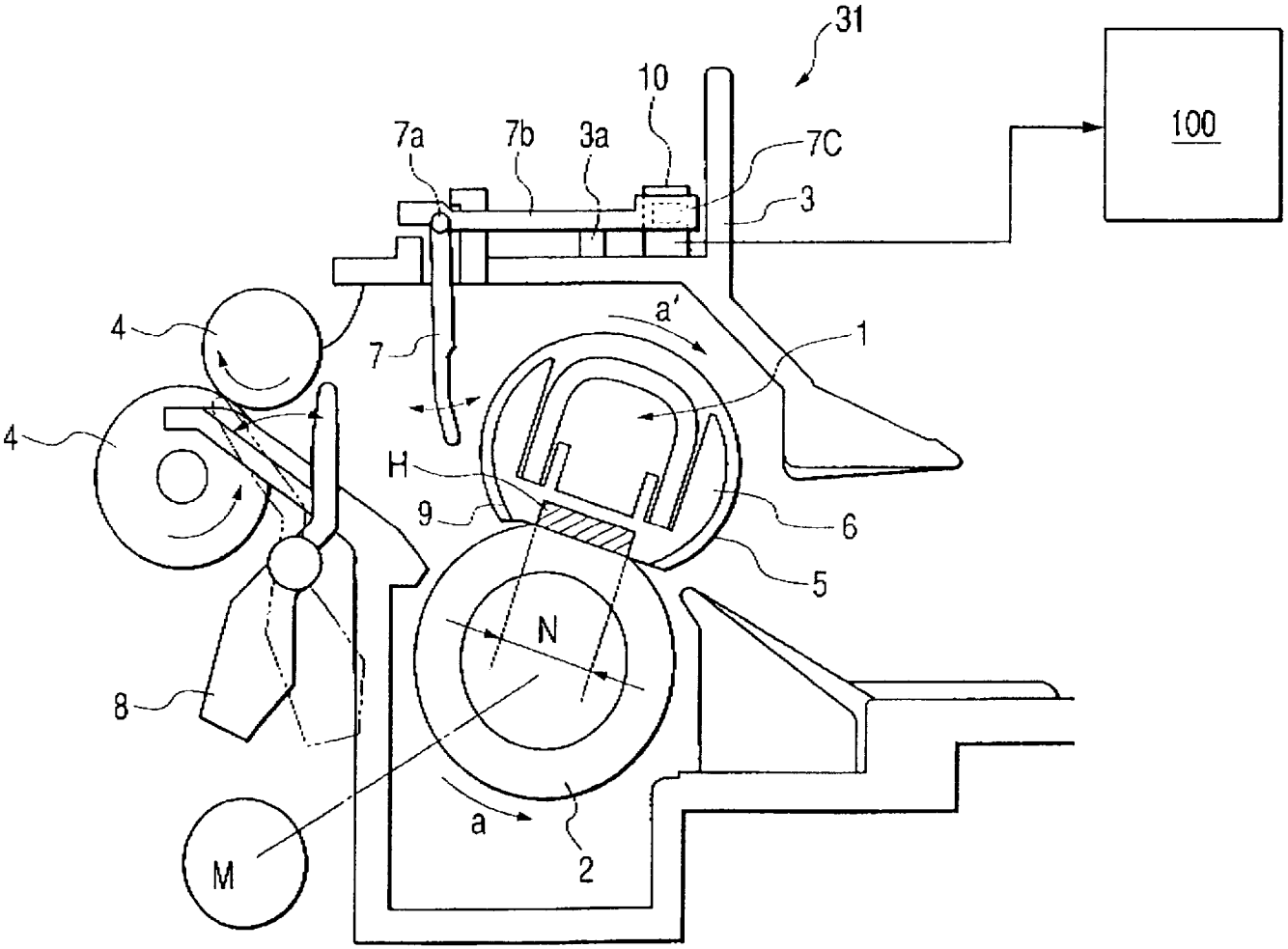
FIG. 7 is a schematic cross-sectional view showing a fixing device in accordance with a second embodiment of the present invention.
Figure 8:
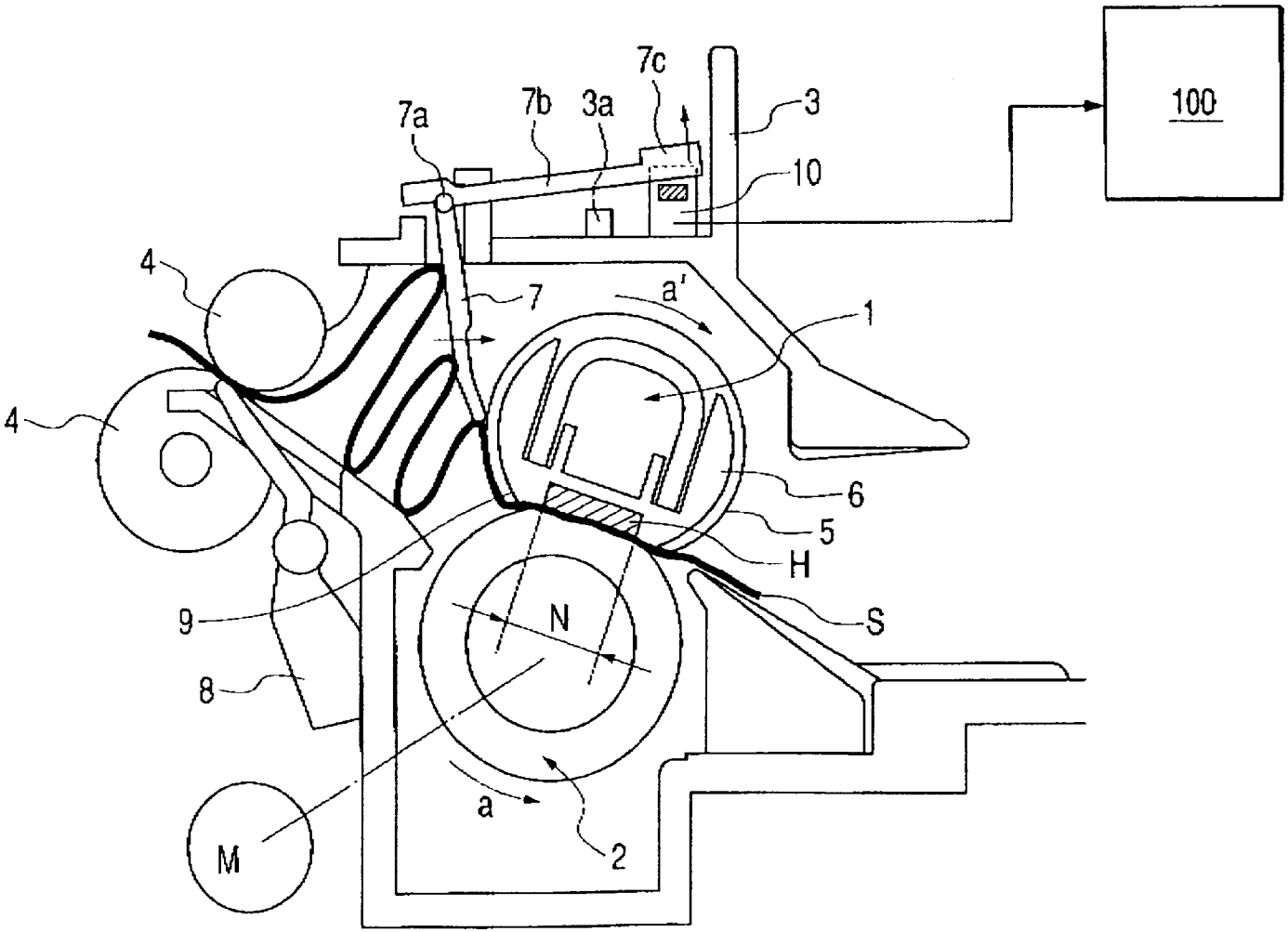
FIG. 8 is a schematic cross-sectional view showing a jamming state.
Figure 9:
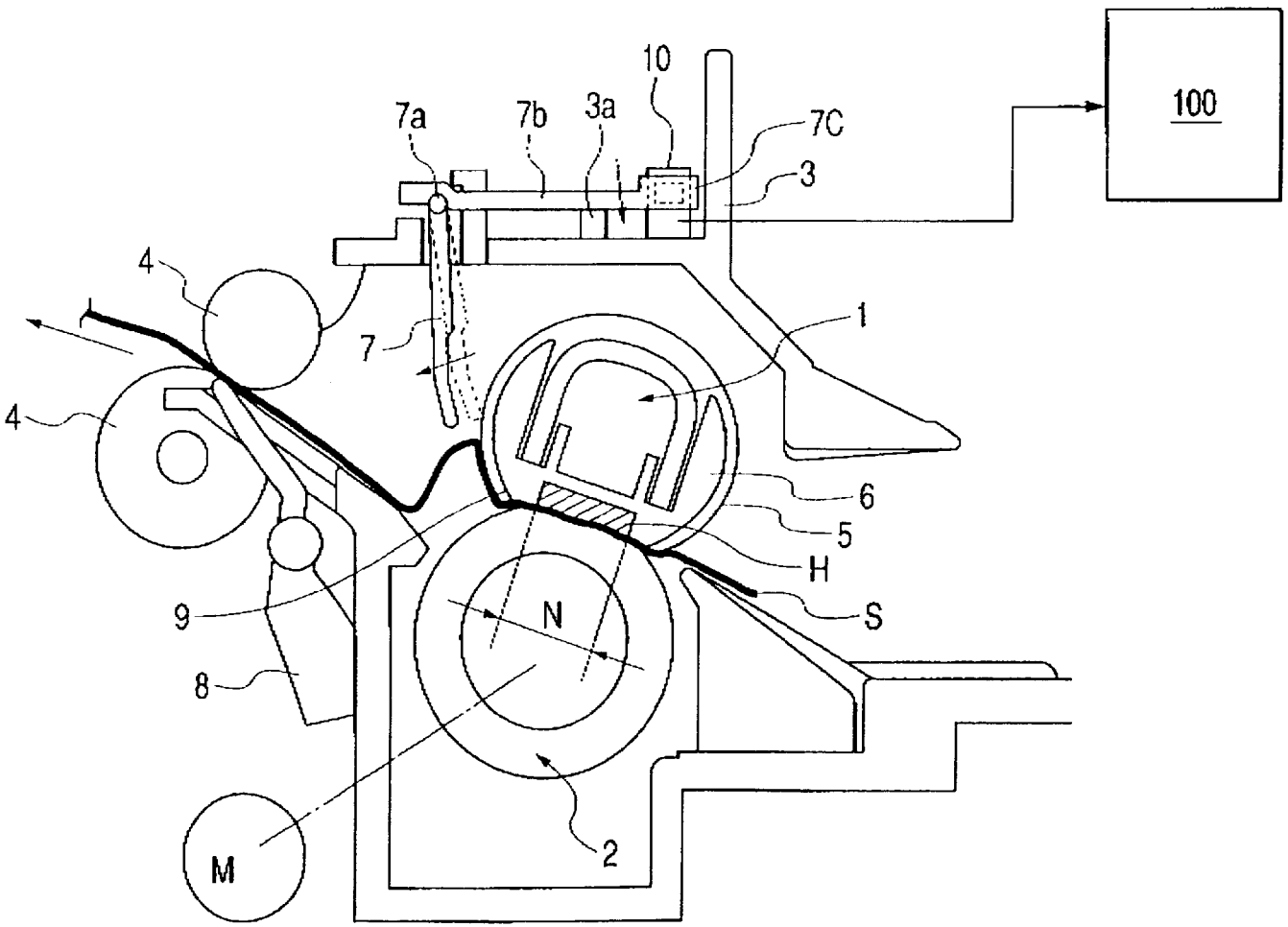
FIG. 9 is a schematic cross-sectional view showing a jam clearance.

FIGS. 7 to 9 are schematic structural views showing a fixing device 31 in accordance with a second embodiment.

The fixing device 31 is equipped with a jam detecting sensor 10 that detects jamming in accordance with a positional change between the stationary state of the separation claw 7 and the separation claw 7 at the time where jamming occurs, and stops a printer drive means including a pressure roller unit drive means M in response to the detection of jamming by the sensor 10.

Other structures of the fixing device and the printer are identical with those of the first embodiment, and therefore the like structural members and parts are designated by identical reference numerals, and their repeated description will be omitted.

The jam detecting sensor 10 is, for example, a photo coupler which is disposed on the upper surface of the fixing cover 3. The leading end portion 7*c* of an arm portion 7*b* of the separation claw 7 which is bent at substantially a right angle with respect to the jam detecting sensor 10 is concerned as a sensor flag.

In other words, in the stationary state, the arm portion 7*b* of the separation claw 7 is in a rotating position state in that the arm portion 7*b* falls down and rotates in the clockwise direction with the lateral shaft portion 7*a* as a center by the self weight of the arm portion 7*b*, and is then received by the receiving portion 3*a* disposed on the upper surface of the fixing cover 3. The photocoupler that functions as the jam detecting sensor 10 is made in the switched-off state because a sensor optical path is blocked by the distal end flag portion 7*c* of the arm portion 7*b* which is in the rotating position state (FIG. 7).

When jamming occurs, as described above, the jammed recording sheet portion is brought in contact with and pressed by the outer surface of the separation claw, to thereby allow the separation claw 7 to rotate with the lateral shaft portion 7*a* as a center in the counterclockwise direction, and the distal end is abutted against the surface of the thin heat-resistant film 5 of the heating unit 1, and the arm portion 7*b* becomes in a state where the arm portion 7*b* is lifted up from the receiving portion 3*a* on the upper surface of the fixing cover 3 and floats, and the distal end flag portion 7*c* of the arm portion 7*b* is escaped from the sensor optical path of the photo coupler 10. As a result, the photo coupler 10 becomes in the switched-on state because the sensor optical path is opened (FIG. 8).

The on-signal of the photo coupler 10 is a jam detection signal, and the control circuit 100 emergently stops the printer drive means including the pressure roller unit drive means M on the basis of the jam detection signal.

As a result, the recording sheet S is transported as much as the inertia of the drive mean M and then stops. As described above, because the drive means M stops immediately after jamming has been detected, a stress applied to the thin heat-resistant film 5 is smaller than that in the first embodiment.

Subsequently, the jam clearance will be described. When the recording sheet S that has been in the accordion state is drawn from the downstream of the pair of delivery rollers 4, the accordion portion at the downstream side within the fixing cover 3 disappears as shown in FIG. 9, and the separation claw 7 is returned to the stationary state by the self weight of the arm portion 7*b*, and the photo coupler 10 that functions as the jam detecting sensor is returned to the switched-off state because the sensor optical path is blocked by the distal end flag portion 7*c* of the arm portion 7*b*.

Thereafter, the recording sheet S is drawn out of the pair of delivery rollers 4 side without difficulty, and the jam clearance is attained without tearing the jammed sheet.

As described above, the reset process of the printer is conducted after the jammed recording sheet has been removed, thereby being capable of re-starting the printing operation.

As described above, according to this embodiment, the separation claw 7 is arranged without contacting with the thin heat-resistant film 5 during the normal fixing time, and the smooth distal end of the separation claw 7 does not come in contact with the thin heat-resistant film 5 until the jamming occurs, and the drive-means M stops due to the detection of jamming. As a result, no excessive force is applied to the thin heat-resistant film 5, a damage and an excessive abrasion on the thin heat-resistant film 5, and the toner stain caused by the separation claw 7 are reduced as much as possible, and the twine of the recording sheet S around the heating unit 1 is prevented with a relatively inexpensive mechanism, to thereby make it possible that the user conducts the jam clearance according to a simple procedure.

The jam detecting sensor 10 is not limited to the photo coupler, but may be formed of another sensor/relay such as a micro switch.

(Third Embodiment)

Figure 10:
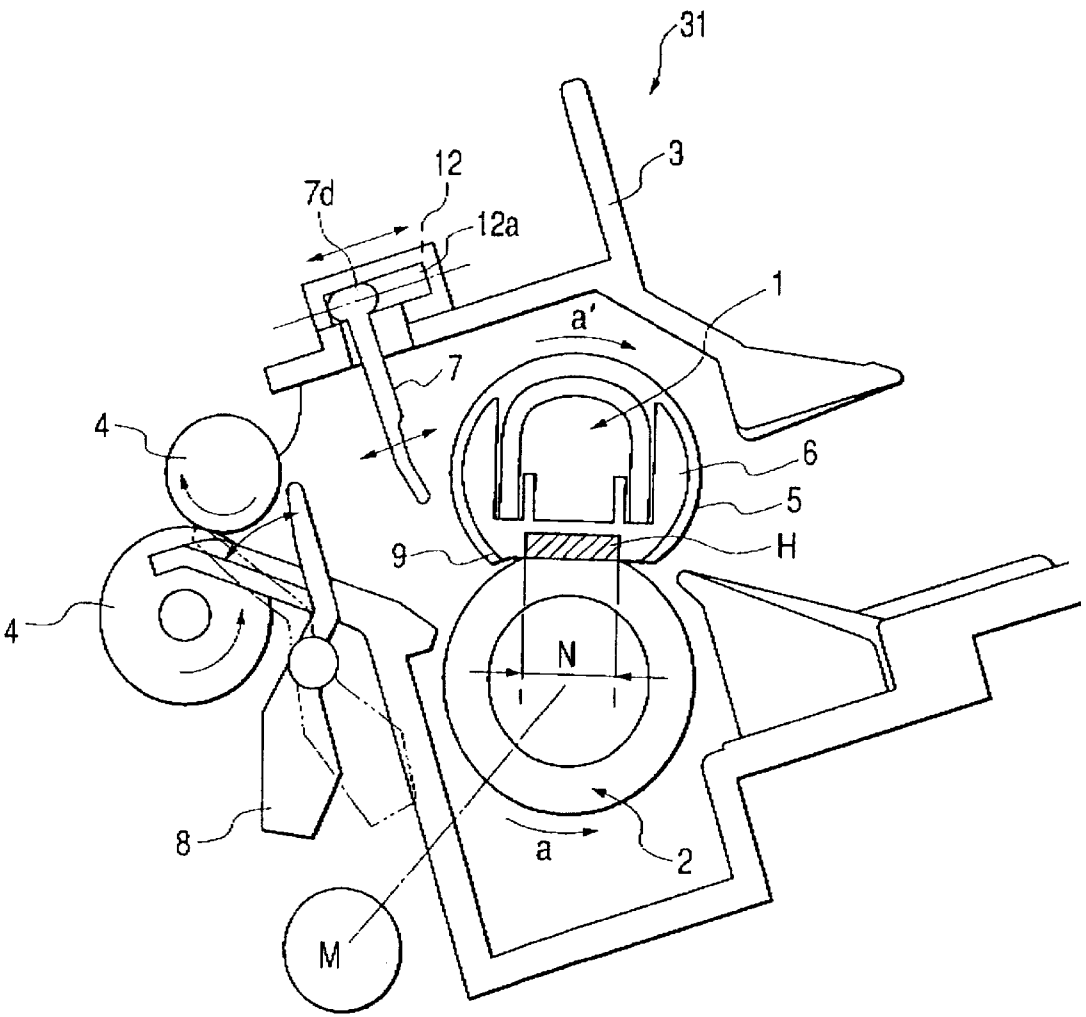
FIG. 10 is a schematic cross-sectional view showing a fixing device in accordance with a third embodiment of the present invention.
Figure 11:
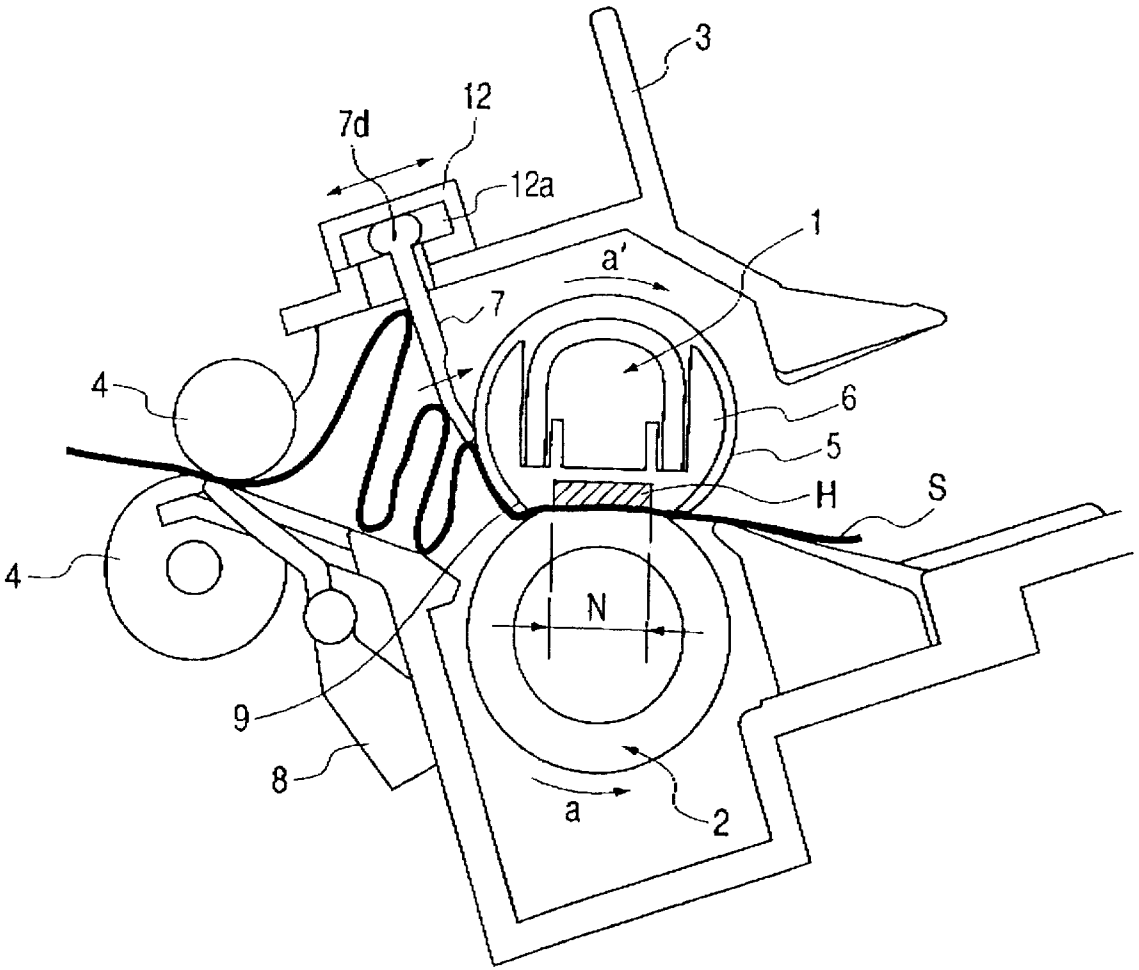
FIG. 11 is a schematic cross-sectional view showing a jamming state.
Figure 12:
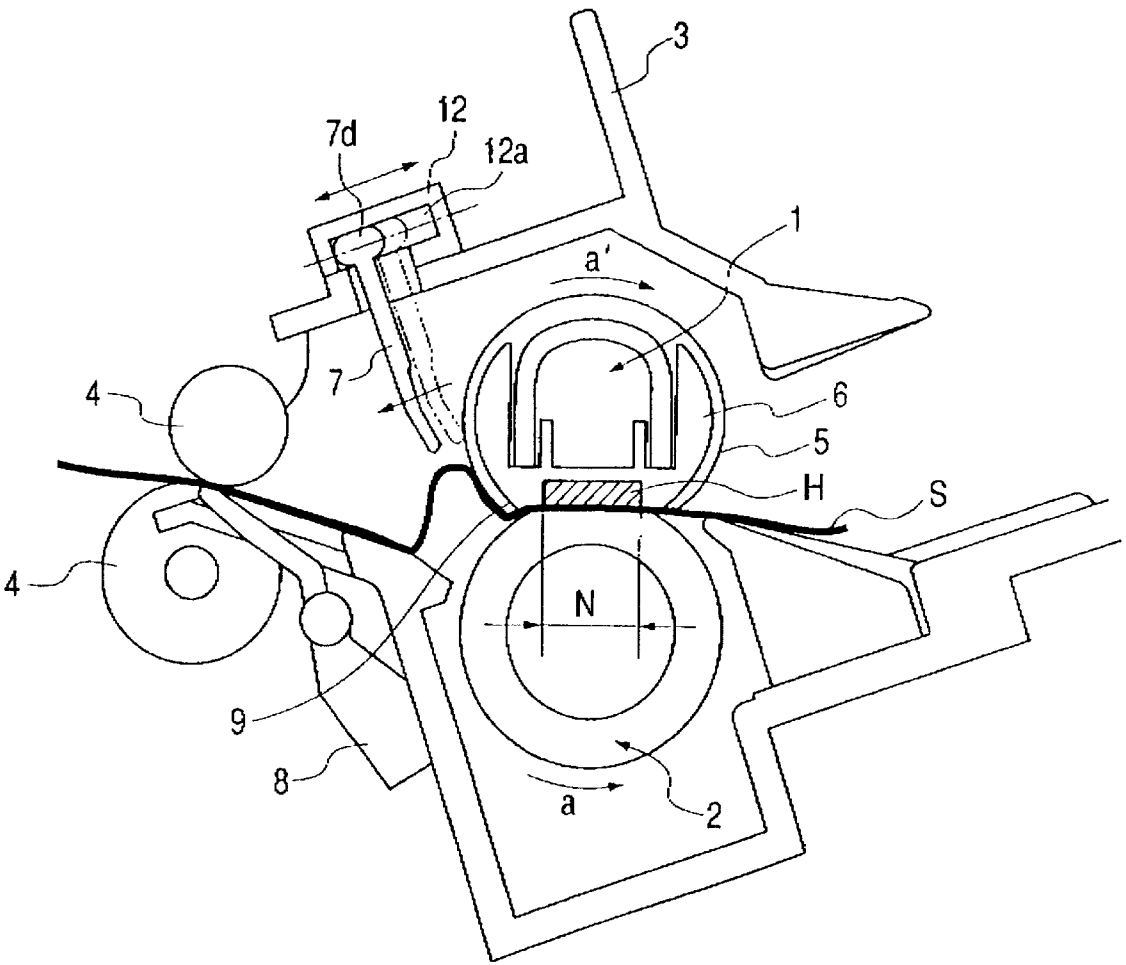
FIG. 12 is a schematic cross-sectional view showing a jam clearance.

FIGS. 10 to 12 are schematic structural views showing a fixing device 31 in accordance with a third embodiment.

The fixing device 31 is designed such that, in the fixing device 31 according to the first embodiment, a slider head portion 7*d* is disposed on the upper end portion of the separation claw 7, the slider head portion 7*d* is engaged with and held by a slit hole 12*a* of a slit hole member 12 provided in the fixing cover 3, and the separation claw 7 is hung from the fixing cover 3 downstream of the nip portion of the heating unit 1 (downstream of the nip portion in the recording sheet transporting direction).

The slit hole 12*a* is longitudinal in the recording sheet transporting direction and inclined leftward and downward. It is desirable that the angle of inclination is set to 15° or more.

The slider head portion 7*d* of the separation claw 7 is slidable along the longitudinal direction of the slit hole 12*a*. That is, the separation claw 7 is movable linearly in the ontact-separation direction in that the separation claw 7 is brought into contact with and separated from the heating unit 1 by sliding the slider head portion 7*d* in the slit hole 12*a*.

Other structures of the fixing device and the printer are identical with those of the first embodiment, and therefore the like structural members and parts are designated by identical reference numerals, and their repeated description will be omitted.

In the stationary state, as shown in FIG. 10, the head portion 7*d* of the separation claw 7 slides down along the inclined surface of the inclined slit hole 12*a* by its self weight and is then held at a position in that the head portion 7*d* is received by a slit hole end portion at its side, and the leading end portion of the separation claw 7 is apart from the surface of the thin heat-resistant film 5 of the heating unit 1.

In the above-mentioned structure, when the recording sheet S is not transported forwardly from the pair of delivery rollers 4 due to some cause, the recording sheet S becomes in an accordion state within the fixing cover 3 and between the pair of delivery rollers 4 and the nip portion N, and the jammed recording sheet portion is brought in contact with the outer surface side of the separation claw 7 (a surface of the separation claw 7 opposite to the heating unit 1 side) and pressed, with the result that the separation claw 7 is pushed against its self weight and starts to move toward the heating unit 1 side along the slit hole 12*a*, and the smooth distal end of the separation claw 7 with a radius R of 0.5 mm and the surface of the thin heat-resistant film 5 of the heating unit 1 are finally abutted against each other.

In addition, when the recording sheet S is transported, there is no space to which the recording sheet S goes, as a result of which the recording sheet S and the thin heat-resistant film 5 are not separated from each other at the separation curved portion 9, and the recording sheet S starts to be brought in close contact with and twined around the thin heat-resistant film 5 through the toner.

The recording sheet S that has started to be twined around the thin heat-resistant film 5 is partially separated from the thin heat-resistant film 5 due to the separation claw 7 that is abutted against the surface of the thin heat-resistant film 5 of the heating unit 1, to thereby prevent the twine winding of the recording sheet S.

FIG. 11 is a diagram showing the above-mentioned jamming state of the recording sheet S. The separation claw 7 is pushed toward the heating unit 1 side against its self weight by pushing the jammed recording sheet portion in contact with the outer surface of the separation claw with the result that its distal end portion is abutted against the surface of the thin heat-resistant film 5 of the heating unit 1.

When the recording sheet S that cannot go anywhere is further transported, the recording sheet S becomes in a small accordion state at the lower portion of the separation claw 7, or slips at the nip portion N.

The emergent stop of the printer drive means including the pressure roller unit drive means M in accordance with the detection of jamming by the control portion is made at the time where the duration of the on-signal from the sensor portion on the basis of the fall-down of the delivery sensor flag 8 exceeds the predetermined range as described in the first embodiment.

Subsequently, the jam clearance will be described. When the recording sheet S that is in the accordion state is drawn out of the downstream side of the pair of delivery rollers 4, the accordion portion at the downstream side within the fixing cover 3 disappears as shown in FIG. 12, and the head portion 7*d* of the separation claw 7 slides down along the inclined surface of the inclined slit hole 12*a* by its self weight and is then held at a position in that the head portion 7*d* is received by the slit hole end portion at its side. Then, the separation claw 7 is returned to the stationary state position where the separation claw leading end portion is apart from the surface of the thin heat-resistant film 5.

Thereafter, the recording sheet S is drawn out of the pair of delivery rollers 4 side without difficulty, and the jam clearance is attained without the jammed sheet.

As described above, the reset process of the printer is conducted after the jammed recording sheet has been removed, thereby being capable of re-starting the printing operation.

As described above, according to this embodiment, the separation claw 7 is arranged without contacting with the thin heat-resistant film 5 of the heating unit 1 during the normal fixing time, and the separation claw 7 does not come in contact with the thin heat-resistant film 5 until the jamming occurs. For that reason, no excessive force is applied to the thin heat-resistant film 5, a damage and an excessive abrasion on the thin heat-resistant film 5, and the toner stain caused by the separation claw 7 are reduced as much as possible, and the twine of the recording sheet S on the heating unit 1 is prevented with a relatively inexpensive mechanism, to thereby make it possible that the user conducts the jam clearance according to a simple procedure. Also, because a method of arranging the separation claw 7 is simple, and the separation claw 7 is arranged from the upper side of the fixing cover 3, the separation claw 7 can be assembled without damaging the heating unit 1.

In addition, because the distal end of the separation claw 7 is smoothly shaped with a radius R of 0.5 mm, it is possible to further prevent the thin heat-resistant film 5 from being damaged.

(Fourth Embodiment)

Figure 13:
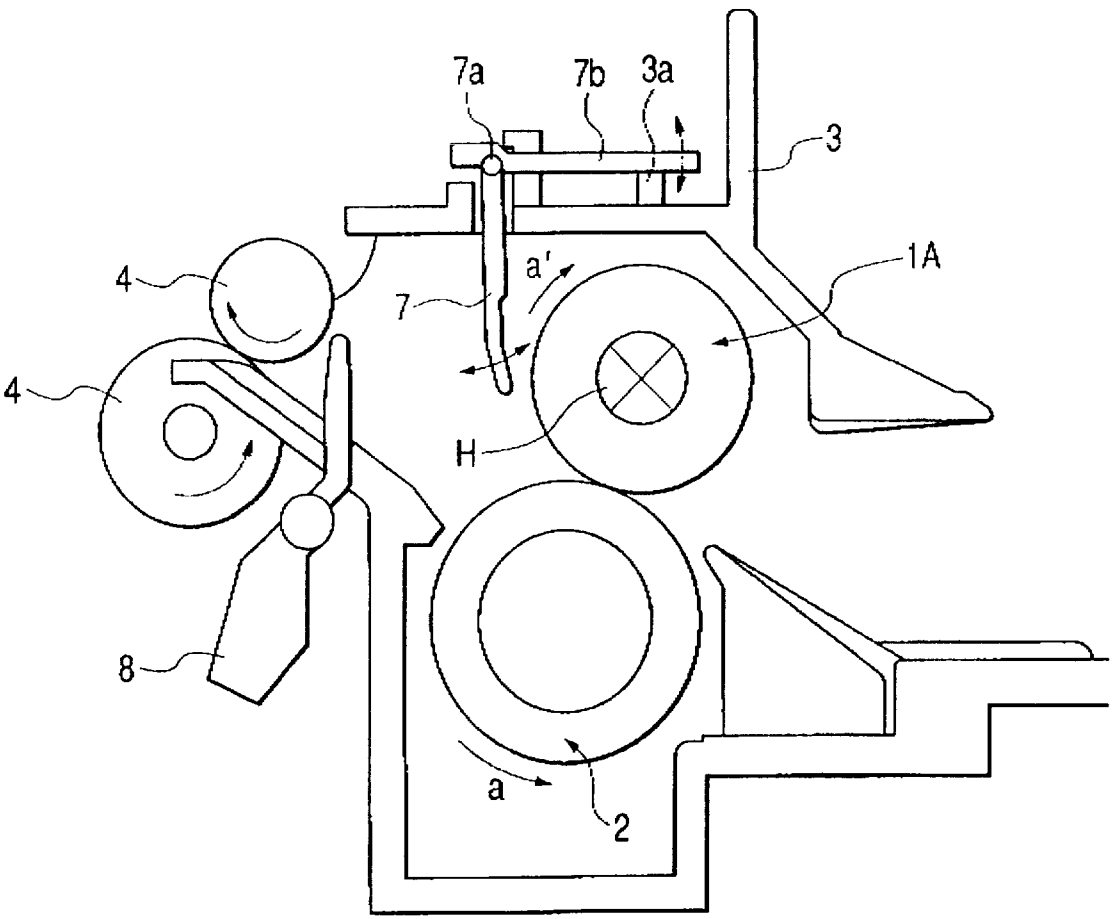
FIG. 13 is a schematic cross-sectional view showing a fixing device in accordance with a fourth embodiment of the present invention.

The above-mentioned respective embodiments exhibit examples using the thin heat-resistant film 5 as the heating unit 1. However, the present invention is not, limited to those examples and may be formed of a heating unit 1A of the heat roller type in which a heater H is arranged in the center thereof as shown in FIG. 13.

(Others)

1) The image heating apparatus of the respective embodiments are fixing devices, but the image heating apparatus according to the present invention includes not only the fixing device but also an image heating apparatus that conducts a pre-fixing process, a surface reforming process such as enameling.

2) It is needless to say that the present invention is applicable to an image heating apparatus of another heating system such as an electromagnetic induction heating system.

3) It is needless to say that the image forming principle, process and system of the recording sheet is not limited to the transfer electrophotographic system. The present invention may be applied to the image forming system of the direct system using a photosensitive sheet or an electrostatic recording sheet, an electrostatic recording system, a magnetic recording system or the like.

The present invention is not limited to the above-mentioned examples, but includes modified examples identical in the technical concept.

The foregoing description of the preferred embodiments of the invention has been presented for purposes of illustration and description. It is not intended to be exhaustive or to limit the invention to the precise form disclosed, and modifications and variations are possible In light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image heating apparatus, comprising:

heating means having a nip portion that nips and transports a recording material that bears an image, said heating means having a rotary member that comes into contact with the recording material; and a moving member disposed downstream of the nip portion in a moving direction of the recording material so as to be movable between a first position in which said moving member abuts against said rotary member and a second position in which said moving member is apart from said rotary member, wherein said moving member is positioned in the second position when the recording material is normally transported and when the recording material is not in the vicinity of the nip portion, and said moving member moves to the first position when the recording material is abnormally transported downstream of the nip portion.

2. An image heating apparatus according to claim 1, wherein said moving member is pushed by the recording material and moved to the first position when the recording material is abnormally transported downstream of the nip portion.

3. An image heating apparatus according to claim 2, wherein said moving member is positioned in the second position by its self weight when said moving member is not pushed by the recording material.

4. An image heating apparatus according to claim 1, wherein said moving member has a function of separating the recording material from said rotary member.

5. An image heating apparatus according to claim 4, wherein a portion of said moving member which is abutted against said rotary member is shaped into a curved surface having a radius of curvature of 0.5 mm or more.

6. An image heating apparatus according to claim 4, wherein when said moving member is positioned in the second position, a distance between a distal end of said moving member and said rotary member ranges from 0.2 mm to 5 mm.

7. An image heating apparatus according to claim 1, wherein said image heating apparatus has a function of detecting an abnormal transportation of the recording material, and said moving member serves as a part of the function.

8. An image heating apparatus according to claim 1, further comprising a cover that is opposed to a peripheral surface of said rotary member, wherein said moving member is provided on said cover.

9. An image heating apparatus according to claim 1, wherein said rotary member comprises a film-shaped member.

10. An image heating apparatus according to claim 1, wherein said rotary member comprises a roller-shaped member.

11. An image heating apparatus, comprising:

heating means having a nip portion that nips and transports a recording material that bears an image, said heating means having a rotary member that comes into contact with the recording material; and a moving member dispersed downstream of the nip portion in a moving direction of the recording material so as to be movable between a first position in which said moving member abuts against said rotary member and a second position in which said moving member is apart from said rotary member, wherein said moving member is positioned in the first position only when the recording material is abnormally transported downstream of the nip portion, and at other times said moving member is positioned in the second position.

12. An image heating apparatus according to claim 11, wherein said moving member is pushed by the recording material and moved to the first position when the recording material is abnormally transported downstream of the nip portion.

13. An image heating apparatus according to claim 12, wherein said moving member is positioned in the second position by its self weight when said moving member is not pushed by the recording material.

14. An image heating apparatus according to claim 11, wherein said moving member has a function of separating the recording material from said rotary member.

15. An image heating apparatus according to claim 14, wherein a portion of said moving member which is abutted against said rotary member is shaped into a curved surface having a radius of curvature of 0.5 mm or more.

16. An image heating apparatus according to claim 14, wherein when said moving member is positioned in the second position, a distance between a distal end of said moving member and said rotary member ranges from 0.2 mm to 5 mm.

17. An image heating apparatus according to claim 11, wherein said image heating apparatus has a function of detecting an abnormal transportation of the recording material, and said moving member serves as a part of the function.

18. An image heating apparatus according to claim 11, further comprising a cover that is opposed to a peripheral surface of said rotary member, wherein said moving member is provided on said cover.

19. An image heating apparatus according to claim 11, wherein said rotary member comprises a film-shaped member.

20. An image heating apparatus according to claim 11, wherein said rotary member comprises a roller-shaped member.

* * * * *

UNITED STATES PATENT AND TRADEMARK OFFICE

CERTIFICATE OF CORRECTION

PATENT NO. : 6,615,017 B2
DATED : September 2, 2003
INVENTOR(S) : Noriaki Tanaka It is certified that error appears in the above-identified patent and that said Letters Patent is hereby corrected as shown below:

Title page,
Item [57], ABSTRACT,
Line 7, "position" should read -- position in which --.

Column 5,
Line 32, "sowing" should read -- showing --.

Column 12,
Line 61, "self" should read -- own --.

Signed and Sealed this

Ninth Day of December, 2003

JAMES E. ROGAN
*Director of the United States Patent and Trademark Office*